US008194906B2

(12) United States Patent
Ryou et al.

(10) Patent No.: US 8,194,906 B2
(45) Date of Patent: Jun. 5, 2012

(54) ANTENNA AND SPEAKER ASSEMBLY AND WIRELESS COMMUNICATION DEVICE

(75) Inventors: Byung Hoon Ryou, Seoul (KR); Won Mo Sung, Gyeonggi-do (KR); Dong Suk Lee, Gyeonggi-do (KR)

(73) Assignee: EMW Co., Ltd., Incheon (KR)

( * ) Notice: Subject to any disclaimer, the term of this patent is extended or adjusted under 35 U.S.C. 154(b) by 808 days.

(21) Appl. No.: 12/161,954

(22) PCT Filed: Jan. 23, 2007

(86) PCT No.: PCT/KR2007/000382

§ 371 (c)(1),
(2), (4) Date: Jan. 20, 2009

(87) PCT Pub. No.: WO2007/086669

PCT Pub. Date: Aug. 2, 2007

(65) Prior Publication Data

US 2009/0220116 A1 Sep. 3, 2009

(30) Foreign Application Priority Data

Jan. 24, 2006 (KR) ..... 20-2006-0002155 U

(51) Int. Cl.
*H04R 1/02* (2006.01)

(52) U.S. Cl. ..... 381/354

(58) Field of Classification Search ..... 381/150, 381/354, 355, 372, 375; 343/872–873
See application file for complete search history.

(56) References Cited

U.S. PATENT DOCUMENTS 6,642,907 B2 * 11/2003 Hamada et al. ..... 343/873
7,079,086 B2 * 7/2006 Aisenbrey ..... 343/872
7,565,178 B1 * 7/2009 Sitachitt et al. ..... 455/569.1
2003/0003970 A1 * 1/2003 Johnson et al. ..... 455/569
2005/0014537 A1 1/2005 Gammon et al.
2005/0024273 A1 2/2005 Hayes (Continued)

FOREIGN PATENT DOCUMENTS

EP 1 317 116 A1 6/2003

(Continued)

OTHER PUBLICATIONS

Office Action for corresponding Japanese Application No. 2008-552221, 2 pgs., (Sep. 7, 2009).

(Continued)

*Primary Examiner* — Tuyen Nguyen
(74) *Attorney, Agent, or Firm* — The PL Law Group, PLLC

(57) ABSTRACT

Disclosed is an antenna-speaker assembly, including an antenna unit including a radiator, a speaker unit including a speaker and coupled to the antenna unit, and a sound-absorbing part formed to conform to a circumference of a coupling surface of the antenna unit and the speaker unit, the sound-absorbing part being interposed between the antenna unit and the speaker unit. According to the present invention, the antenna-speaker assembly equipped with the structure of generating clear sound is provided. Furthermore, in a wireless communication device including an antenna-speaker assembly, the antenna-speaker assembly include an antenna unit including a radiator, a speaker unit including a speaker and coupled to the antenna unit, and a sound-absorbing material formed on a circumference of a face where the antenna unit and the speaker unit are coupled in such a manner as to be interposed between the antenna unit and the speaker unit.

6 Claims, 4 Drawing Sheets

U.S. PATENT DOCUMENTS

| | | | | |
|---|---|---|---|---|
| 2008/0019502 | A1 * | 1/2008 | Emmert et al. | 379/433.07 |
| 2010/0220887 | A1 * | 9/2010 | Welker et al. | 381/386 |

FOREIGN PATENT DOCUMENTS

| | | | |
|---|---|---|---|
| EP | 1 445 823 | A1 | 8/2004 |
| JP | 1-79880 | | 5/1989 |
| JP | 10327489 | | 12/1998 |
| JP | 2004-172764 | | 6/2004 |
| JP | 2004-283825 | A | 10/2004 |
| JP | 2005-536912 | A | 12/2005 |
| KR | 10-2005-0033764 | A | 4/2005 |
| WO | WO 03/030297 | A1 | 4/2003 |
| WO | WO 03/077507 | A1 | 9/2003 |
| WO | WO 2004/004408 | A1 | 1/2004 |
| WO | WO 2004004408 | A1 * | 1/2004 |
| WO | WO 2004/070871 | A1 | 8/2004 |

OTHER PUBLICATIONS

Decision of Refusal or corresponding Japanese Application No. 2008-552221, 2 pgs., (Mar. 8, 2010).

PCT International Search Report for corresponding PCT Application No. PCT/KR2007/000382, 3 pgs., (Apr. 27, 2007).

Extended European Search Report for corresponding European Application No. 07708563.7-1248, 6 pgs., (Aug. 20, 2009).

Office Action for corresponding European Application No. 07708563.7-1248, 1 pg., (Dec. 2, 2009).

Decision to Grant o corresponding Korean Application No. 20-2006-0002155, 3 pgs., (Jun. 30, 2010).

* cited by examiner

[Fig. 1]
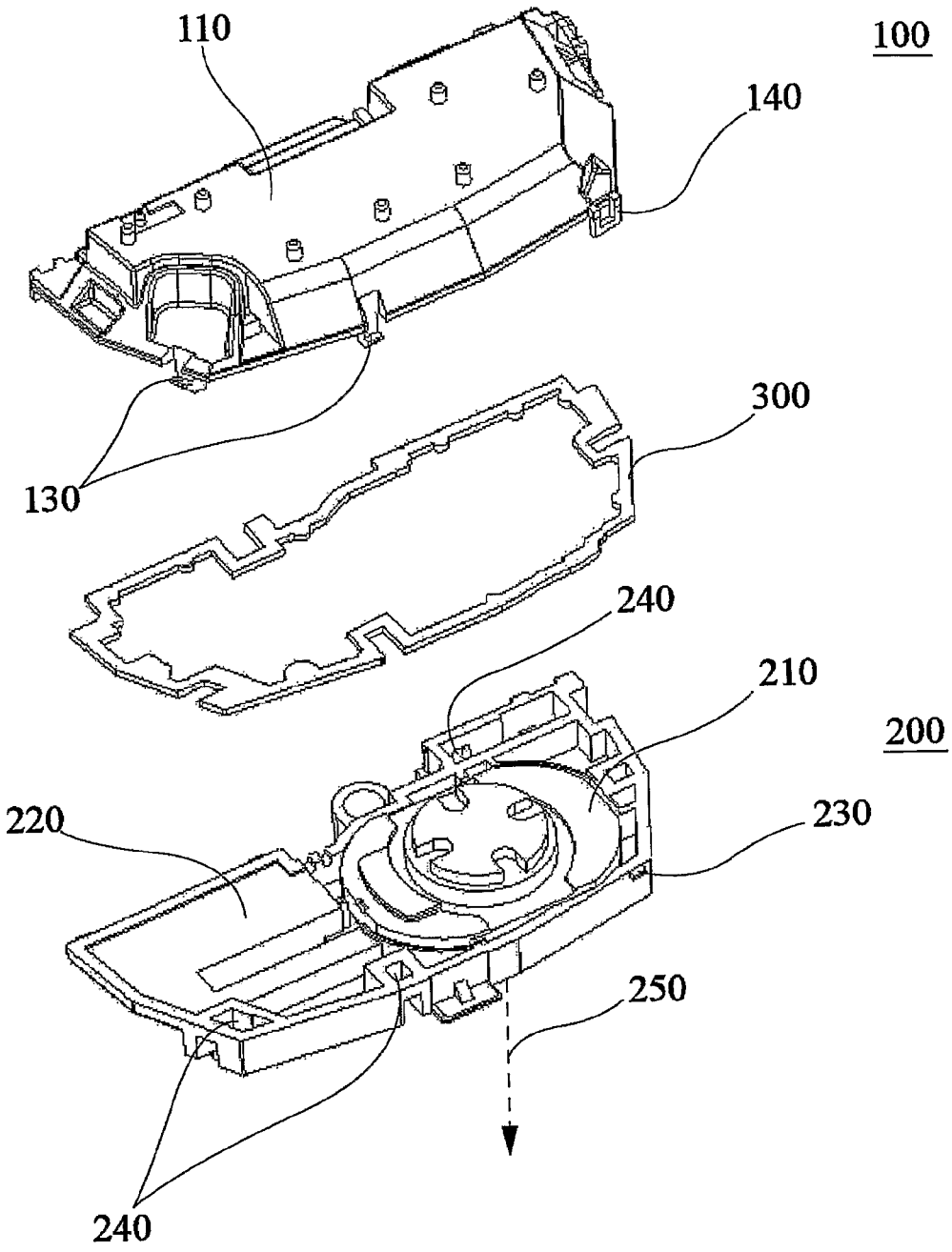

[Fig. 2]
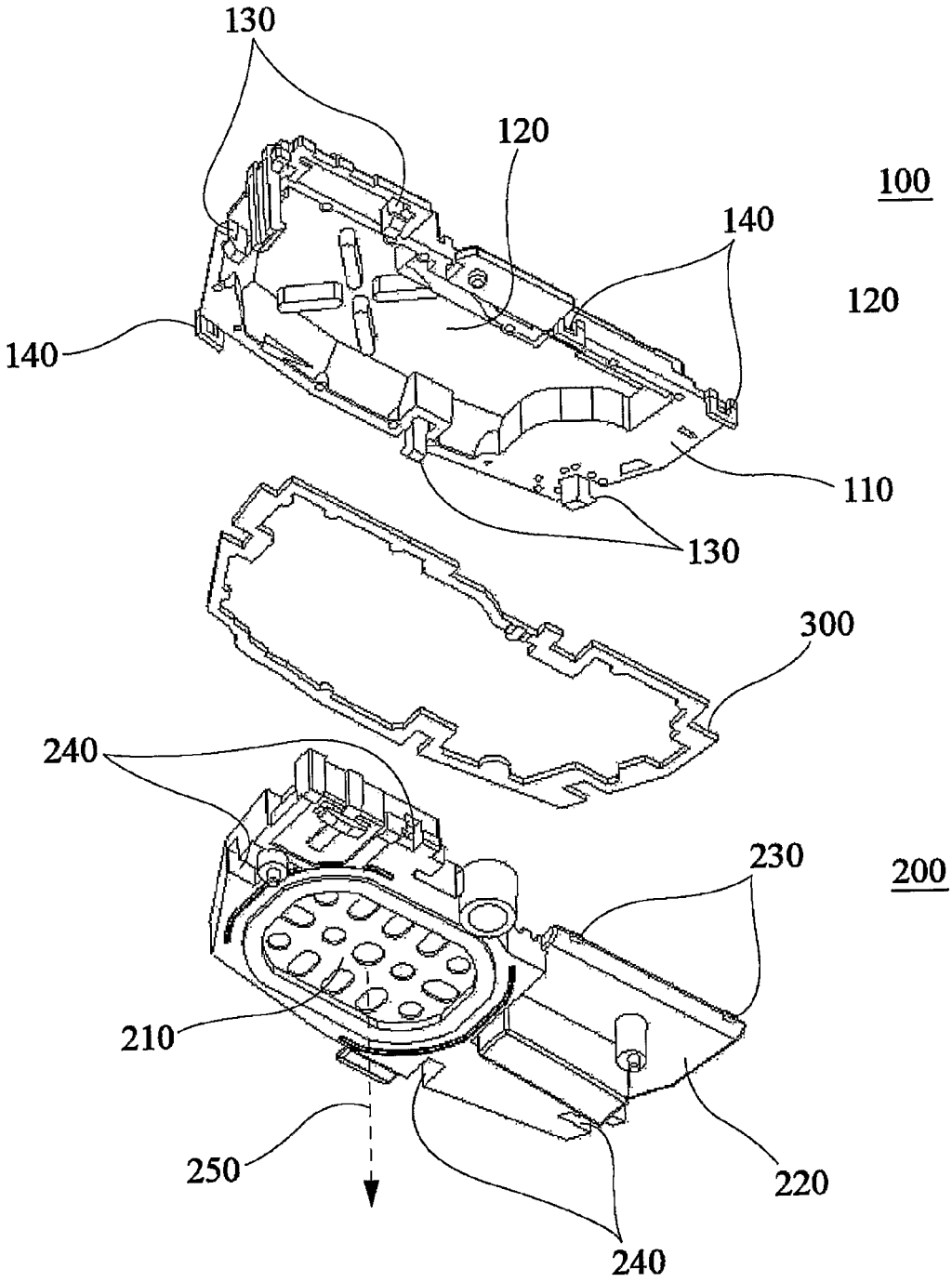

[Fig. 3]
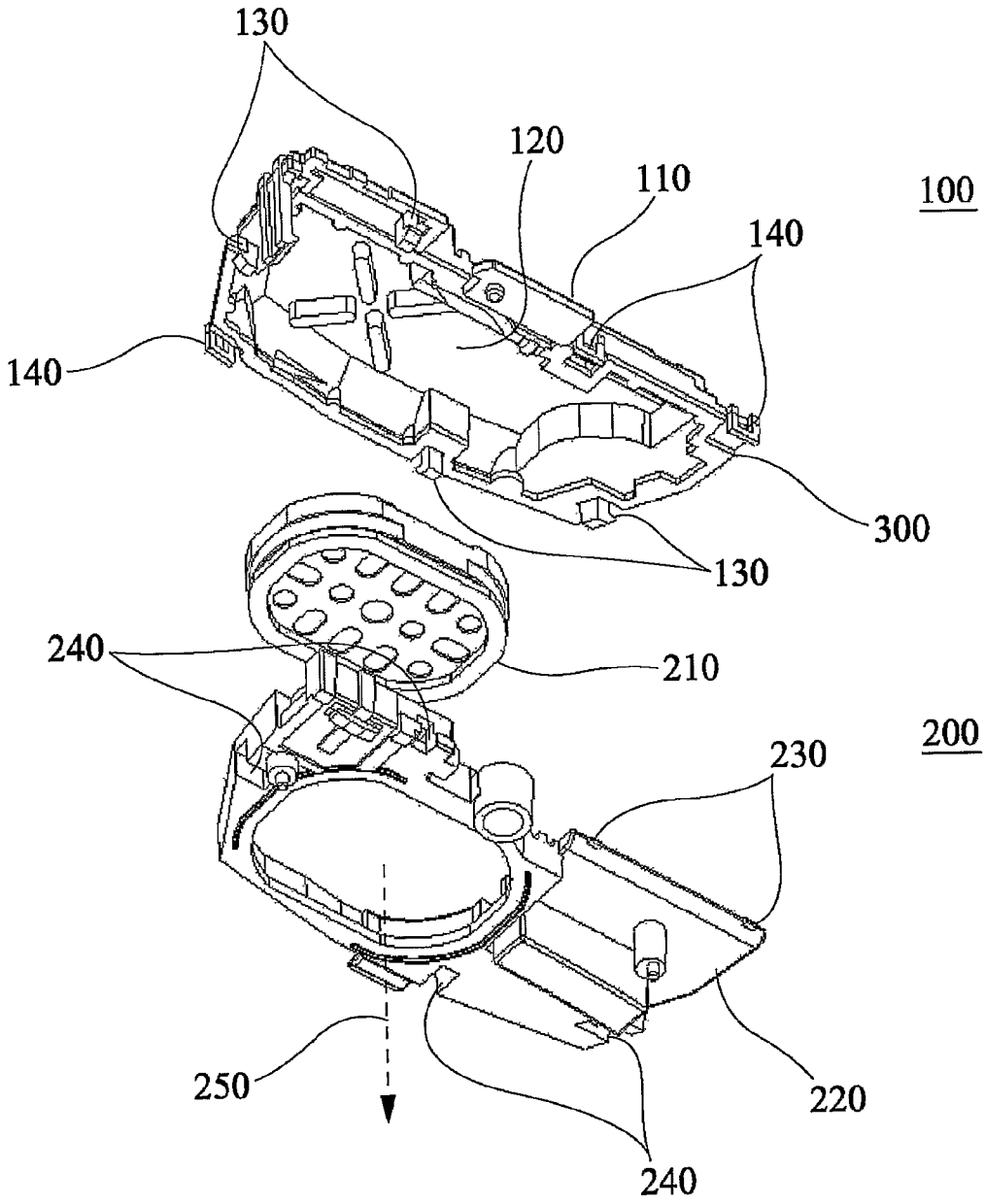

[Fig. 4]
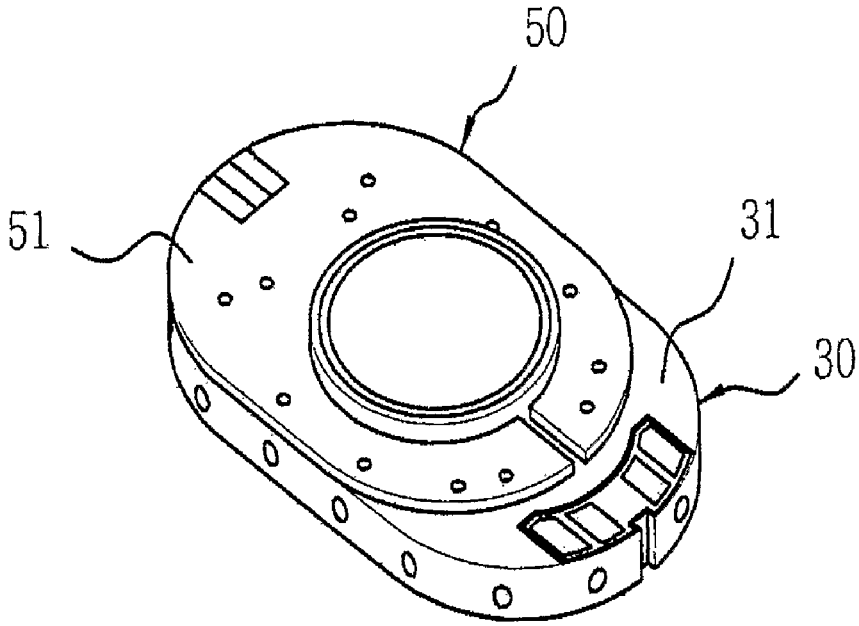

ANTENNA AND SPEAKER ASSEMBLY AND WIRELESS COMMUNICATION DEVICE

CROSS-REFERENCE TO OTHER APPLICATIONS

This is a National Phase of International Application No. PCT/KR2007/000382, filed on Jan. 23, 2007, which claims priority from Korean Patent Application No. 20-2006-0002155, filed on Jan. 24, 2006.

TECHNICAL FIELD

The present invention relates, in general, to an antenna and a speaker mounted in a mobile communication device and a wireless communication device, and more particularly, to an assembly of an antenna and a speaker, and a wireless communication device in which the antenna and speaker assembly is mounted.

BACKGROUND ART

In order to miniaturize mobile communication devices such as mobile phones, a construction in which an internal antenna and a speaker are coupled and modulized has been known. U.S. Patent Laid-Open Publication No. 2005/24273 discloses a construction in which a flat speaker and a planar antenna are coupled. Korea Patent Laid-Open Publication No. 2005-33764 discloses a construction regarding an antenna attached to the bottom of a speaker.

FIG. 4 is a bottom perspective view of an antenna-integrated speaker disclosed in Korea Patent Laid-Open Publication No. 2005-33764. As illustrated in FIG. 4, the antenna-integrated speaker includes an antenna 50 attached to the bottom of a speaker 30, so that the antenna 50 and the speaker 30 are integrally formed with each other. In this construction, a radiation patch 51 is attached to the bottom of a speaker bottom 31 which is a nonconductor. Thus, it is inevitable that the shape of the radiation patch 51 is limited depending on the shape and size of the speaker bottom 31. It makes it difficult to adjust a resonant frequency and bandwidth of electromagnetic waves transmitted and received through the antenna 50.

Accordingly, it is preferred that an antenna unit including dielectric material and a radiator be fabricated in a desired shape and size, a speaker unit be fabricated depending on the shape and size of the antenna unit, and the antenna unit and the speaker unit be then coupled. Such coupling of the antenna unit and the speaker unit can be accomplished through ultrasonic fusion or bond adhesion, which can be easily implemented by those having ordinary skill in the art.

In the coupling of the antenna unit and the speaker unit through ultrasonic fusion, however, the speaker is influenced due to the use of ultrasonics, causing failure in the speaker. There are also problems in that a production cost is high and productivity is low because ultrasonic fusion equipment must be used.

Furthermore, in the coupling of the antenna unit and the speaker unit through bond adhesion, a production time is excessively long and uniform bond coating at an adhered portion is difficult. Gas leaking from the bond gives damage to the external appearance, which requires an additional process of cleaning the damaged external appearance. Further, the gas is detrimental to a manufacturer.

Furthermore, the coupling of the antenna unit and the speaker unit using ultrasonic fusion or bond adhesion is problematic in that there may be a gap between the antenna unit and the speaker unit. Sound generated from the speaker escapes through the gap between the antenna and the speaker as well as an intended sound transfer path from the speaker to a user. In other words, sound generated from the speaker is distributed, and sound reaching to the user is unclear. This problem is not limited to the clearness of a ring tone, but is also related to a solution for securing an improved sound quality in a user's sound listening since the MP3 player is mounted in a mobile communication device.

DISCLOSURE OF INVENTION

Technical Problem

An object of the present invention is to provide an antenna-speaker assembly equipped with a structure of generating clear sound.

Another object of the present invention is to provide an antenna-speaker assembly which is equipped with the structure of generating clear sound and is simply fabricated at low cost.

Yet another object of the present invention is to provide a wireless communication device in which the antenna-speaker assembly is mounted.

Technical Solution

To achieve the above objects, according to an embodiment of the present invention, there is provided an antenna-speaker assembly including an antenna unit including a radiator, a speaker unit including a speaker and coupled to the antenna unit, and a sound-absorbing part formed to conform to a circumference of a coupling surface of the antenna unit and the speaker unit, the sound-absorbing part being interposed between the antenna unit and the speaker unit.

The sound-absorbing part preferably is of thermoplastic elastomer (TPE) material.

It is preferred that projections may be formed on one of the antenna unit and the speaker unit, and fastening rings be formed on the other of the antenna unit and the speaker unit to correspond to the projections.

The sound-absorbing material is preferably integrally formed with the antenna unit or the speaker unit by means of dual injection molding.

According to another embodiment of the present invention, there is provided a wireless communication device including an antenna-speaker assembly, the antenna-speaker assembly including an antenna unit including a radiator, a speaker unit including a speaker and coupled to the antenna unit, and a sound-absorbing material formed on a circumference of a face where the antenna unit and the speaker unit are coupled in such a manner as to be interposed between the antenna unit and the speaker unit.

The sound-absorbing material preferably includes thermoplastic elastomer (TPE) material.

It is preferred that projections be formed on one side of the antenna unit and the speaker unit, and fastening rings be formed on the other side of the antenna unit and the speaker unit to correspond to the projections.

The sound-absorbing material is preferably integrally formed with the antenna unit or the speaker unit by means of dual injection molding.

Advantageous Effects

According to the present invention, an antenna-speaker assembly equipped with the structure of generating clear sound can be provided.

Furthermore, according to the present invention, it is possible to provide an antenna-speaker assembly which is equipped with the structure of generating clear sound and is simply fabricated at low cost.

Furthermore, according to the present invention, a wireless communication device can be provided in which the antenna-speaker assembly is mounted.

BRIEF DESCRIPTION OF THE DRAWINGS

FIG. 1 is an upper exploded perspective view of an antenna-speaker assembly according to a first embodiment of the present invention;

FIG. 2 is a lower exploded perspective view of the antenna-speaker assembly according to a first embodiment of the present invention;

FIG. 3 is an exploded perspective view of an antenna-speaker assembly according to a second embodiment of the present invention; and FIG. 4 is a bottom perspective view of a conventional antenna-integrated speaker.

MODE FOR THE INVENTION

The present invention will now be described in detail in connection with detailed embodiments with reference to the accompanying drawings.

FIGS. 1 and 2 are upper and lower exploded perspective views of an antenna-speaker assembly, respectively, according to a first embodiment of the present invention. FIGS. 1 and 2 are opposite to each other when they are seen as they are.

As illustrated in FIGS. 1 and 2, an antenna-speaker assembly according to the present embodiment includes an antenna unit 100, a speaker unit 200 coupled to the antenna unit 100, and a sound-absorbing material 300 formed on the circumference of a face where the antenna unit 100 and the speaker unit 200 are coupled in such a manner as to be interposed between the antenna unit 100 and the speaker unit 200. Projections 130 and 230 are formed on one side of the antenna unit 100 and the speaker unit 200, and fastening rings 240 and 140 corresponding to the projections 130 and 230 are formed on the other side of the antenna unit 100 and the speaker unit 200.

The antenna unit 100 includes a radiator (not illustrated) for transmitting and receiving electromagnetic waves, and dielectric material 110 for maintaining the shape of the a radiator. The a radiator (not illustrated) may be formed on the dielectric material 110. The dielectric material 110 may have a space 120 formed therein to the extent that it does not hinder the functions of the antenna. The antenna unit 100 can serve as a resonant tube of the speaker 210.

The speaker unit 200 includes a speaker 210 and a speaker frame 220. The speaker frame 220 may have a given shape for facilitating the coupling of the speaker 210 to the antenna unit 100. The speaker unit 200 may not include the speaker frame 220. In this case, the speaker 210 may have a given shape that can be easily coupled to the antenna unit 100.

The sound-absorbing material 300 fills a gap that may exist between the antenna unit 100 and the speaker unit 200, and precludes sound, generated from the speaker 210, from leaking outside the antenna-speaker assembly through the gap. Therefore, sound generated from the speaker 210 is not distributed, and can be transferred to a user along only an intended sound transfer path 250 in a state where it maintains its clearness. Furthermore, the antenna unit 100 can serve as the resonant tube of the speaker 210, so that the quality of sound generated from the speaker 210 can be improved.

The projections 130 and 230 may have a hook 130 or a projection 230 having a rectangular parallelepiped. The projections 130 and 230 and the fastening rings 240 and 140 corresponding thereto are means for coupling the antenna unit 100 and the speaker unit 200, so that the antenna unit 100 and the speaker unit 100 can be coupled through a simple assembly. In particular, if a material with elasticity is used as the sound-absorbing material 300 interposed between the antenna unit 100 and the speaker unit 200, the coupling of the antenna unit 100 and the speaker unit 200 can be further fastened. TPE can be used as the sound-absorbing material with elasticity. The TPE is polymer material, which has plasticity at high temperature and elasticity at normal temperature. The TPE is classified into Thermoplastic Styrenic Block Copolymer (SBC), Thermoplastic Olefinic Elastomer (TPO), Thermoplastic Polyurethane (TPU), Thermoplastic Polyamide Elastomer (TPAE), Thermoplastic Polyester Elastomer (TPEE) and so on, depending on material.

The means for coupling the antenna unit 100 and the speaker unit 200 may include any means that can be easily implemented by a person having ordinary skill in the art as well as the projections 130 and 230 and the fastening rings 240 and 140 corresponding thereto.

The antenna-speaker assembly according to the present embodiment modulates the coupling of the antenna unit 100 and the speaker unit 200, and thus contributes to the miniaturization of mobile communication devices, such as mobile phones, so that the shape of the antenna is not restricted by the shape of the speaker 210. It allows an antenna to be freely designed. Furthermore, since the sound-absorbing material 300 is interposed between the antenna unit 100 and the speaker unit 200, sound generated from the speaker 210 can be transferred to a user clearly. In particular, in the case where the antenna unit 100 serves as the resonant tube of the speaker 210, there is an advantage in that the sound quality can be improved. In addition, as the projections 130 and 230 and the fastening rings 240 and 140 corresponding thereto are used as the means for coupling the antenna unit 100 and the speaker unit 200, a manufacturing process can be simplified, a manufacturing cost can be saved, and a manufacturing time can be shortened, compared with the prior art, while firmly coupling the antenna unit 100 and the speaker unit 200.

FIG. 3 is an exploded perspective view of an antenna-speaker assembly according to a second embodiment of the present invention. The antenna-speaker assembly according to the present embodiment, includes as illustrated in FIG. 3, an antenna unit 100, a speaker unit 200 coupled to the antenna unit 100, and a sound-absorbing material 300 formed on the circumference of a face where the antenna unit 100 and the speaker unit 200 are coupled in such a manner as to be interposed between the antenna unit 100 and the speaker unit 200. The sound-absorbing material 300 is integrally formed with the antenna unit 100 by means of dual injection molding. Furthermore, the speaker unit 200 includes a speaker 210 and a speaker frame 220. The speaker 210 and the speaker frame 220 are separately fabricated and then assembled. In the present embodiment, the same reference numerals will be used to refer to the same parts as those of the previous embodiment, and their repeated explanations are omitted, as applicable.

In integrally forming the sound-absorbing material 300 and the antenna unit 100 through dual injection molding, a method of first forming the dielectric material 110 in a first frame through injection molding, placing the dielectric material 110 in a second frame, and then injecting the sound-absorbing material 300 can be employed. As an alternative method, the sound-absorbing material 300 can be integrally formed with the speaker unit 200 by means of dual injection molding. In this case, a method of first forming the speaker frame 220 in a first frame through injection molding, placing the speaker frame 220 in a second frame, and then injecting the sound-absorbing material 300 can be employed.

The speaker frame 220 can have a speaker 210 mounted therein, and is also fabricated so that it is easily coupled to the antenna unit 100. The speaker 210 is mounted on the speaker frame 220, and is then fastened through close adhesion of its upper and lower parts when the antenna unit 100 and the speaker frame 220 are assembled. In this case, a gap may occur between the speaker 210 and the speaker frame 220. However, the path of sound through the gap from the speaker 210 approaches an intended sound transfer path 250, and the path and the intended sound transfer path 250 are identical to each other. Thus, the gap does not hinder the clearness of the sound generated from the speaker 210.

As described above, in accordance with the antenna-speaker assembly according to the present embodiment, the sound-absorbing material 300 is integrally formed with the antenna unit 100 or the speaker unit 200 by means of dual injection molding. It is thus not necessary to separately insert the sound-absorbing material 300 when coupling the antenna unit 100 and the speaker unit 200. Therefore, the coupling of the antenna unit 100 and the speaker unit 200 can be performed more easily. Furthermore, since the speaker frame 220 is formed separately from the speaker 210, the fabrication of the speaker unit 200 can be simplified.

Although the specific embodiments of the present invention have been disclosed for illustrative purposes, those skilled in the art will appreciate that various modifications, additions and substitutions are possible, without departing from the scope and spirit of the invention as disclosed in the accompanying claims.

What is claimed:

1. An antenna-speaker assembly, comprising:

an antenna unit including a radiator;

a speaker unit including a speaker and coupled to the antenna unit, wherein projections are formed on one of the antenna unit and the speaker unit, and fastening rings are formed on the other of the antenna unit and the speaker unit to correspond to the projections; and a sound-absorbing part formed to conform to a circumference of a coupling surface of the antenna unit and the speaker unit, the sound-absorbing part being interposed between the antenna unit and the speaker unit.

2. The antenna-speaker assembly of claim 1, wherein the sound-absorbing part is of a thermoplastic elastomer (TPE) material.

3. The antenna-speaker assembly of claim 1, wherein the sound-absorbing material is integrally formed with the antenna unit or the speaker unit by means of dual injection molding.

4. A wireless communication device including an antenna-speaker assembly, wherein the antenna-speaker assembly comprises:

an antenna unit including a radiator;

a speaker unit including a speaker and coupled to the antenna unit, wherein projections are formed on one side of the antenna unit and the speaker unit, and fastening rings are formed on the other side of the antenna unit and the speaker unit to correspond to the projections; and a sound-absorbing material formed on a circumference of a face where the antenna unit and the speaker unit are coupled in such a manner as to be interposed between the antenna unit and the speaker unit.

5. The wireless communication device of claim 4, wherein the sound-absorbing material includes thermoplastic elastomer (TPE) material.

6. The wireless communication device of claim 4, wherein the sound-absorbing material is integrally formed with the antenna unit or the speaker unit by means of dual injection molding.

* * * * *